US007757308B2

(12) United States Patent
Oomae

(10) Patent No.: US 7,757,308 B2
(45) Date of Patent: Jul. 20, 2010

(54) CLOTHING WITH ADJUSTABLE WAIST SIZE

(75) Inventor: Takako Oomae, Matsue (JP)

(73) Assignee: Minami Honten Corporation, Matsue-shi (JP)

( * ) Notice: Subject to any disclaimer, the term of this patent is extended or adjusted under 35 U.S.C. 154(b) by 649 days.

(21) Appl. No.: 11/691,500

(22) Filed: Mar. 27, 2007

(65) Prior Publication Data

US 2007/0261150 A1 Nov. 15, 2007

Related U.S. Application Data

(63) Continuation-in-part of application No. 11/382,935, filed on May 12, 2006, now abandoned.

(51) Int. Cl.
*A41D 1/06* (2006.01)

(52) U.S. Cl. ..... 2/237; 2/221

(58) Field of Classification Search ..... 2/236, 2/219, 220, 221, 229, 235, 311, 237
See application file for complete search history.

(56) References Cited

U.S. PATENT DOCUMENTS 700,903 A * 5/1902 Davis ..... 2/237
2,223,157 A * 11/1940 Berger ..... 2/237
2,583,992 A * 1/1952 Bouteloup ..... 2/237
3,515,143 A * 6/1970 Black ..... 450/109
3,812,541 A * 5/1974 Stuart ..... 2/237
3,835,473 A * 9/1974 Toyoda ..... 2/237
4,193,136 A * 3/1980 Pierce ..... 2/237
4,596,055 A * 6/1986 Aach et al. ..... 2/237
5,544,366 A * 8/1996 Kato ..... 2/237
6,081,930 A * 7/2000 Phillips ..... 2/237
6,526,597 B1 * 3/2003 Shepard ..... 2/255
6,880,175 B2 * 4/2005 Tajima et al. ..... 2/237

* cited by examiner

*Primary Examiner*—Katherine Moran
*Assistant Examiner*—Richale L Quinn
(74) *Attorney, Agent, or Firm*—Judge Patent Associates

(57) ABSTRACT

Clothing includes a body part, a waistband part circumferentially provided at an upper end of the body part and having opposite end portions, and a rubber band encapsulated in the waistband part. Locking units are provided on a surface of the end portion and a back face of the end portion, opposite ends of the rubber band which can be exposed from a side end of the end portion and from a hole portion formed in the back face of the end portion are coupled by a coupling unit so that a length of the rubber band can be adjusted, the opening/closing portions integral with the opposite end portions can be separated leftward and rightward, and the units are invisible from the front when the opening/closing portions are closed. Therefore, clothing with a waist size, which can be adjusted by a wearer, and with good appearance can be provided.

6 Claims, 13 Drawing Sheets

CLOTHING WITH ADJUSTABLE WAIST SIZE

BACKGROUND OF THE INVENTION

1. Technical Field

The present invention relates to clothing such as skirts and trousers. In particular, the present invention relates to clothing with a waist size that can be adjusted by the wearer.

2. Description of the Related Art

Conventionally, many clothes such as skirts and trousers have a fixed waist size and should be altered when a wearer's figure changes in his/her waist size. However, the alteration is an extremely complicated operation and it is not easy for the wearer to adjust the waist size by himself/herself.

To cope with this, there is proposed a universal-waist-size skirt as disclosed in Japanese Utility Model Publication No. 60-49109 (1985), for example.

According to the aforementioned publication, however, it is not easy to adjust a waist size to one which is the fittest for a wearer and also an exposed string or belt makes appearance of the skirt unpleasant. Conventionally, there is also a skirt with an all-round elasticized waistband. However, a large cloth required for a hip portion is secured in cutting and is gathered to a waist portion; therefore, the skirt billows around the waist and looks ugly. Further, the skirt has many gathers and is not fashionable.

BRIEF SUMMARY OF THE INVENTION

The present invention has been made in view of the aforementioned problems in view and it is an object of the present invention to provide clothing, such as skirts and trousers, with a waist size that can be adjusted by the wearer, and to provide such clothing with an excellent appearance.

In order to solve the above problems, clothing such as a skirt or a pair of trousers with an adjustable waist size according to a first aspect of the present invention includes: a body part; a waistband part in a sack shape provided circumferentially along an upper end of the body part, and have opposing end portions being capable to be overlapped with a locking piece; a rubber band or a rubber band with belt interlining encapsulated in the waistband part and elastically expandable and contractible circumferentially along the waist, the rubber band having opposing ends coupled by coupling means for adjusting the length of the rubber band or a rubber band with belt interlining; a rubber band or a rubber band with belt interlining is capable inserting and taking out from one end hole of waistband and from hole prepared on surface or back face of waistband; locking piece connected to one of the opposing end portions of the waistband part, the locking piece covering and hiding the rubber band from being exposed from the end portions of the waistband part and having locking means capable of interlocking with the other end portion of the waistband part to allow the opposing end portions of the waistband part to be engaged with and detached from each other; opening/closing portions formed in the body part integral with lower edges of the opposing end portions of the waistband part and extending to a common terminal position; and an opening/closing means for closably separating the opening/closing portions away from each other.

According to the present invention, a waistband part in a sack shape circumferentially provided at an upper end of the body part and cut and have opposite hole end portions facing each other; and a rubber band or a rubber band with a belt interlining which is encapsulated in the waistband part, which has opposite ends coupled by coupling means so that a length of the rubber band or the rubber band with the belt interlining can be adjusted, and which elastically expands and contracts in a circumferential direction of a waist, wherein the body part is formed with opening/closing portions extending from lower edges of the opposite end portions of the waistband part to a lower position and is provided with opening/closing means extending from upper edges to the lower edges of the opposite end portions of the waistband part and to lower ends of the opening/closing portions so that the opening/closing portions integral with the opposite end portions of the waistband part can be separated leftward and rightward from each other by the opening/closing means. And, one overlapped end portion is bent to be coupled with bended portion, and the locking means for allowing the locking piece connected to one of the end portions of the waistband part to be locked to the other end portion of the waistband part is net and loop that prepared at end of rubber band or rubber band with belt interlining which is able to be fasten by yarns.

According to the present invention, a waistband part circumferentially provided at an upper end of the body part; a belt interlining encapsulated in the waistband part; and a waist size adjusting portion provided in a proper position of the waistband part, wherein: in the waist size adjusting portion; the belt interlining is cut and separated at a predetermined interval to form cut end portions; a net-like member for covering the cut end portions is overlaid on and secured to the cut end portions and the waistband part from inside; a string-like member forming a bottom portion on one end side and coupling means on the other end side and routed in a ring shape between the cut end portions while being slidably hung on the net-like member is provided; and the waist size can be adjusted by pulling an end portion of the string-like member to gather the waistband part.

When the clothing is worn, the rubber band exposed from the opposite end portions of the waistband part is covered and hidden with the locking piece to thereby enhance the appearance.

As a hole is equipped inside or outside of the waistband and consecutive rubber instead of conventional key hook, can be formed a silhouette as same prior one, it can be provided the skirt which is the waist size adjustable to body figure change. The location of hole is near the overlapped portion in case each end of rubber overlapped, and it is most rubber disappear in the case that hole is facing each other. So, minimum exposure of rubber zone is realized because a rubber or belt padding is piled up from the hole and insert into downside waist belt end. Beautiful appearance from the outside can be kept in case of change of clothes. And in case a change of clothes, it is no problem that hip van pass through clothes by loosing a fastener that prepared from under end line of each end of waist band to downward, and extending inserted rubber band. To be able to separate right and left with by both ends department of drawspan and a belt part in a body, and when holding coupling means is closed, hole from which take off the belt rubber is prepared near other belt end and back side of waist belt. As rubber and its joined means can be easily to be pulled up from both end of belt, it is capable to adjust waist size. According to this invention, insert rubber is controllable and can be jointed neither being extremely thick. According to this invention, waist belt is preferable to postpone right and left from fastener stopper for stability and being beautiful.

When the clothing is worn, the rubber band exposed from the opposite end portions of the waistband part is covered and hidden with the locking piece to thereby enhance the appearance.

From the following detailed description in conjunction with the accompanying drawings, the foregoing and other objects, features, aspects and advantages of the present invention will become readily apparent to those skilled in the art.

DETAILED DESCRIPTION OF THE INVENTION

Figure 1:
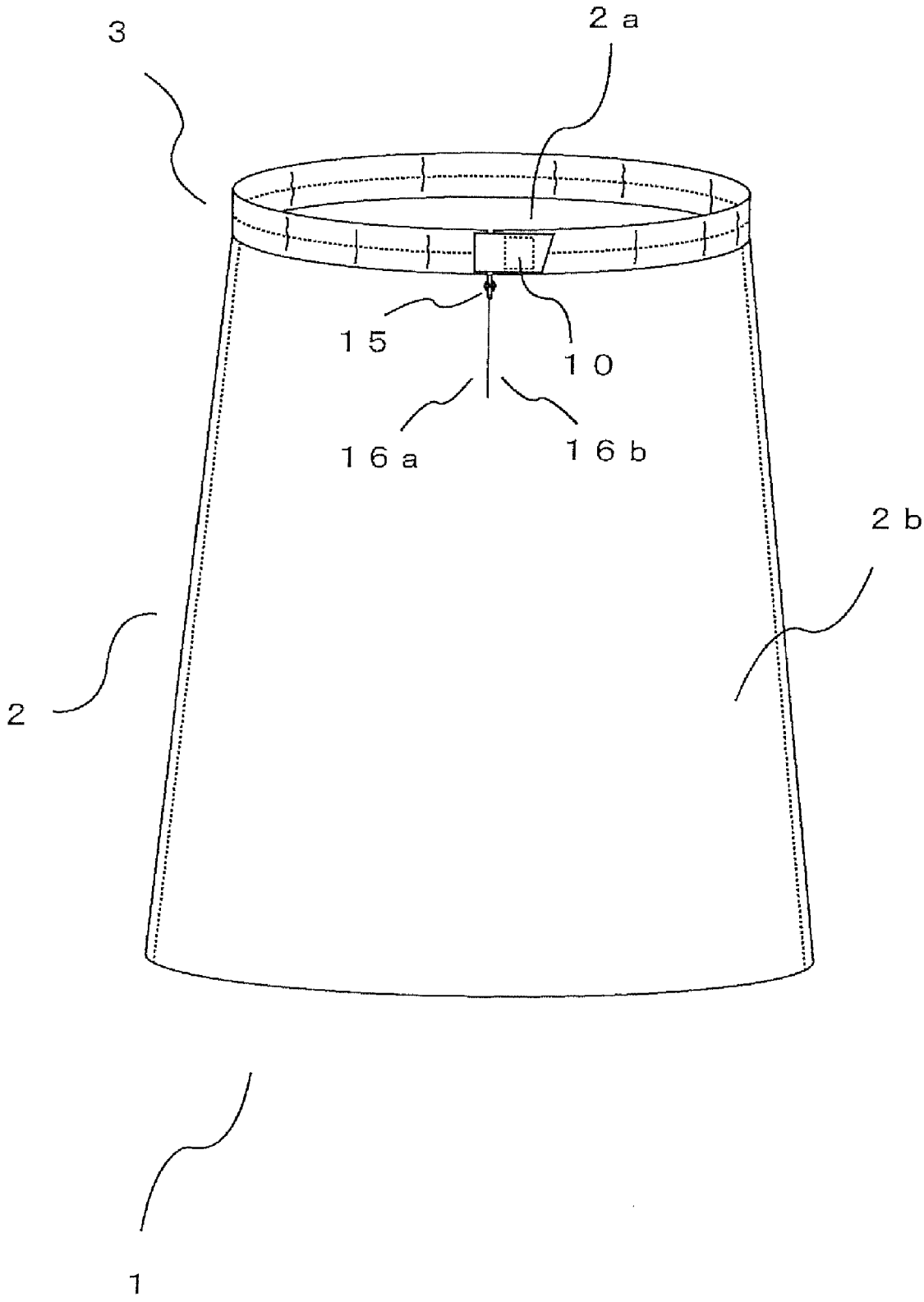
FIG. 1 is a back view of a skirt according to a first embodiment.

Clothing according to the present invention includes any clothing—such as a skirt, a pair of trousers, and a pair of short pants—with a waist size which needs to be adjusted due to a change in the wearer's figure, or for other reasons.

A rubber band encapsulated in a waistband part may be in any shape and of any size as far as the rubber band can elastically expand and contract in a circumferential direction of a waist with its opposite ends coupled and the number of the rubber bands is not limited to one but may be two or more. The coupling means for coupling the opposite ends of the rubber band can firmly couple them to such an extent that the coupling is not undone as the rubber band expands and contracts. For example, means such as knotting the opposite ends together through a knot and sewing the opposite ends together by using a sewing machine or by hand or by plural buttonholes and plural buttons corresponding to them are employed. In the present invention, a phrase, "opposite ends coupled so that a length can be adjusted by coupling means" means that the coupling can be undone and that the opposite ends can be coupled again after a length of the rubber band is adjusted to a required length when a wearer wants to increase or decrease the waist size. In order to adapt to a future increase in the waist size, the opposite ends of the rubber band are preferably coupled while providing the rubber band a certain extra length.

It is also possible to use a rubber band with a belt interlining (interlining material). For example, a structure including 80% belt interlining and 20% rubber band, a structure formed of a rubber band on a back side and a belt interlining on a front side, and the like may be used.

A locking piece may be in any shape and of any size as far as it can cover and hide the rubber band exposed from opposite end portions of the waistband part. As the locking means of the locking piece, a hook-and-pile fastener, a button, a hook, and the like may be used.

A body part is formed with opening/closing portions having opening/closing means and extending from lower edges of opposite end portions of the waistband part to a lower position. As the opening/closing means, a fastener, a button, and the like may be used. The opening/closing means such as the fastener is provided so as to allow a hip portion thicker than the waist to easily pass through the waistband part mainly in taking off and putting on the clothing. By providing such opening/closing means, it becomes unnecessary to secure a large cloth around the waist in consideration of expansion and contraction during passage of the hip portion. As a result, it is possible to reduce gathers at the waist as compared with clothing with an all-round elasticized waistband and without opening/closing means.

Positions of the end portions of the waistband part and positions of the opening/closing portions contiguous to the end portions may be on a front face, a back face, a side face, and the like of the clothing without special limitation.

First Embodiment

A first embodiment of the present invention will be described with reference to FIGS. 1 and 2. As illustrated in FIG. 1, this embodiment relates to a skirt 1 including a body part 2 formed into a cylindrical shape by sewing a front body part 2*a* and a back body part 2*b* made of cotton, wool, synthetic fiber, and the like together and a long and narrow waistband part 3 circumferentially provided at an upper end of the body part 2.

Figure 2:
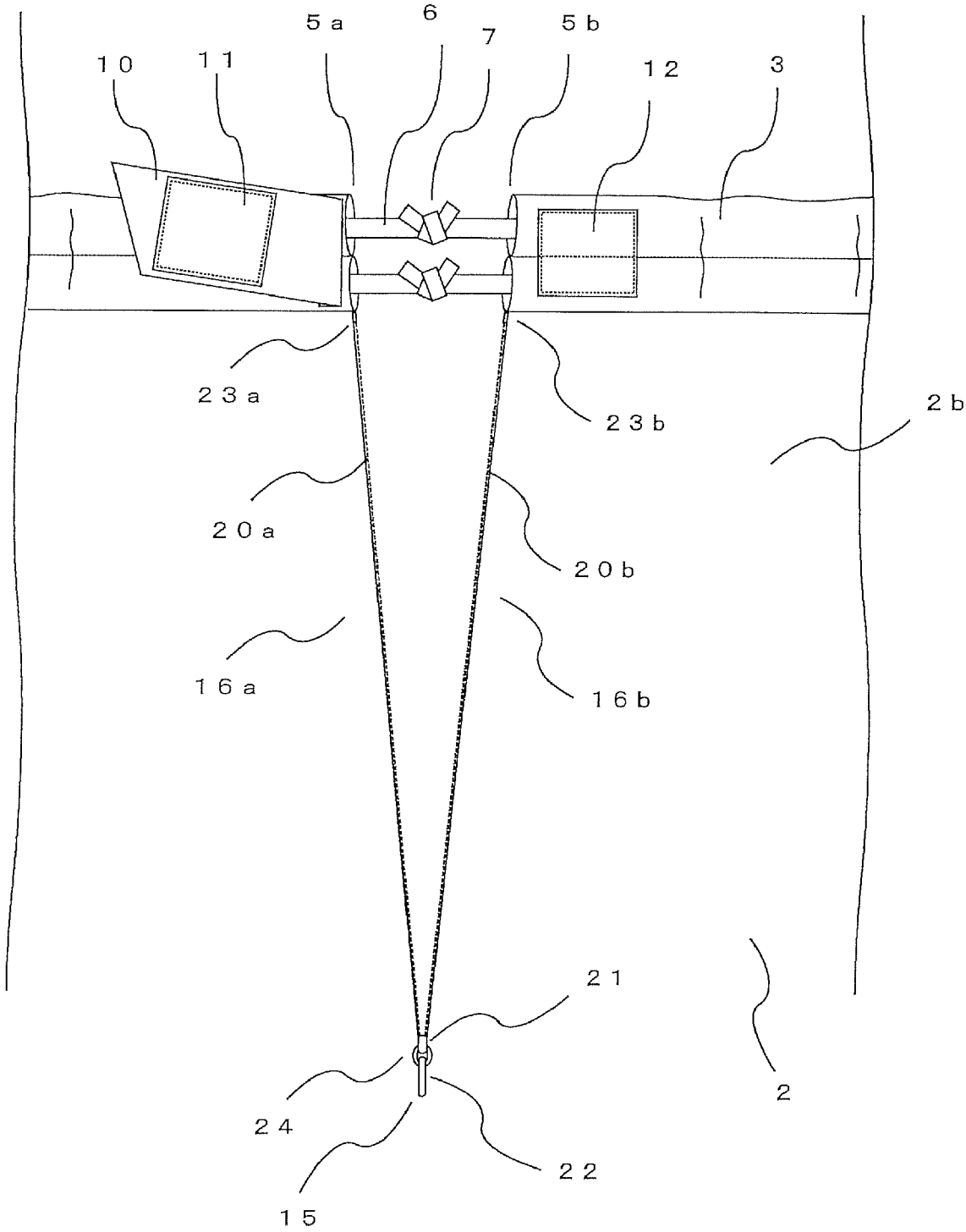
FIG. 2 is a partially enlarged view of the skirt according to the first embodiment.

As illustrated in FIG. 2, the waistband part 3 is cut and separated so as to have opposite end portions 5*a*, 5*b* facing each other at an upper end of the back body part 2*b* and is formed in a sack shape so that a rubber band 6 for elastically expanding and contracting in a circumferential direction of a waist can be encapsulated in the waistband part 3. As illustrated in FIG. 2, the rubber band 6 has a proper length and is formed in a ring shape by coupling opposite ends of the rubber band 6 through a knot which is coupling means 7. In this embodiment, two rubber bands 6 are provided in upper and lower two rows. At a substantially middle position in a vertical direction of the waistband part 3, a front and a back of the waistband part 3 are sewn together, so that the upper and lower rubber bands 6 are able to slide and be retained in predetermined positions, respectively. The knot of each of the rubber bands 6 is preferably put into a position inside the waistband part 3 from which the knot can be taken out easily.

As illustrated in FIG. 2, on a surface in the vicinity of the end portion 5*a* of the waistband part 3, a locking piece 10 is provided with its one end connected to the surface. Through a loop piece 11 of a hook-and-pile fastener sewn and formed on a back face of the locking piece 10 and a hook piece 12 of the hook-and-pile fastener sewn and formed on a surface in the vicinity of the end portion 5*b*, the opposite end portions 5*a*, 5*b* of the waistband part 3 can be engaged with and detached from each other.

As illustrated in FIG. 2, the back body part 2*b* is formed with opening/closing portions 16*a*, 16*b* to extend from a position at lower edges of the opposite end portions 5*a*, 5*b* of the waistband part 3 to a lower position at a distance of about 15 to 20 cm from the lower edges so that the opening/closing portions 16*a*, 16*b* can be brought into contact with and separated from each other by a fastener which is opening/closing means 15. As illustrated in FIG. 2, the fastener includes a pair of left and right engaging portions 20*a*, 20*b* provided along edge ends of the opening/closing portions 16*a*, 16*b*, a slider body 21 for riding up and down the engaging portions 20*a*, 20*b*, and a slider pull 22 for operating the slider body 21. Upper ends 23*a*, 23*b* of the engaging portions 20*a*, 20*b* are aligned with the lower edges of the opposite end portions 5*a*, 5*b* of the waistband part 3, respectively. Thus, the opening/closing portions 16*a*, 16*b* integral with the opposite end portions 5*a*, 5*b* of the waistband part 3 can be separated leftward and rightward from each other to form a substantially V shape.

It is preferable to use an invisible fastener as the fastener in view of the appearance because the engaging portions 20*a*, 20*b* are invisible from the front when the opening/closing portions 16*a*, 16*b* are closed. It is more desirable to make the slider body 21, the slider pull 22, and a ring for connecting both of them as small in size as possible so that they are unobtrusive.

In order to use the skirt 1 formed as described above, the locking piece 10 is engaged/detached and the opening/closing means 15 is moved up/down to put on/take off the skirt.

If the wearer wants to decrease or increase the waist size, the slider body 21 of the fastener is moved to a lower end 24 to fully open the opening/closing portions 16*a*, 16*b*, the coupling means 7 of each of the rubber bands 6 encapsulated in the waistband part 3 is exposed from the opposite end portions 5*a*, 5*b* of the waistband part 3 to undo the coupling, and the opposite ends of the rubber band 6 are knotted and coupled together again while adjusting the length to a required length. Alternatively, the rubber band may be replaced with another of a proper length.

With the skirt according to this embodiment, the wearer can easily adjust the waist size by herself. The fastener as the opening/closing means 15 not only makes it easy to put on/take off the skirt 1 but also makes it easy to adjust the lengths of the rubber bands 6 by easily exposing the knots of the rubber bands 6.

When the skirt 1 is worn, as illustrated in FIG. 1, it looks extremely nice because the rubber bands 6 exposed from the opposite end portions 5*a*, 5*b* of the waistband part 3 are covered with the locking piece 10 and the gathers may be reduced by providing the fastener which is the opening/closing means 15.

Moreover, because the hook-and-pile fastener 11, 12 is used as means of locking the locking piece 10, it is possible to cope with a certain amount of change in the waist without adjusting the lengths of the rubber bands 6.

Second Embodiment

Figure 3:
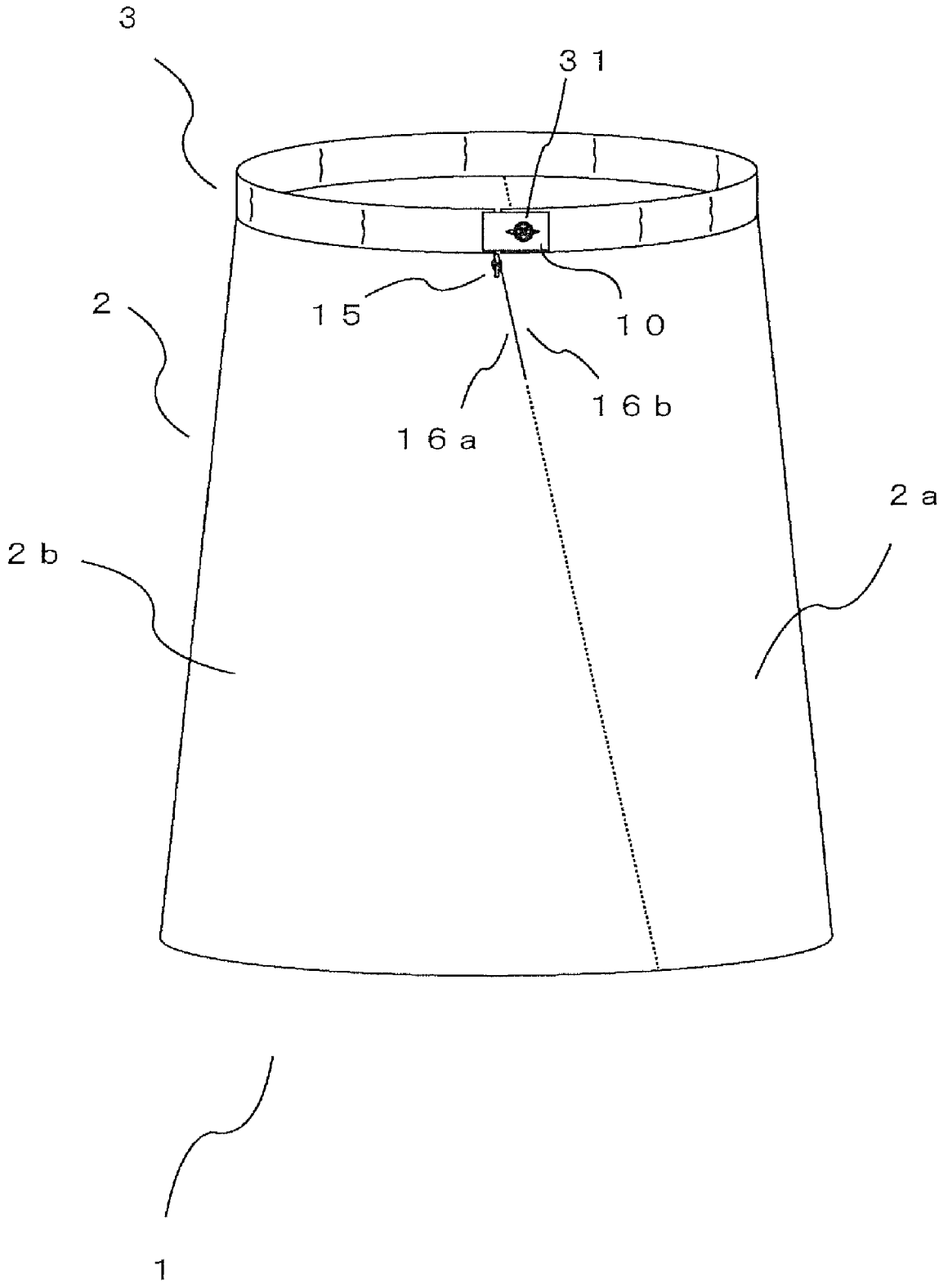
FIG. 3 is a side view of a skirt according to a second embodiment.

A second embodiment of the present invention will be described with reference to FIGS. 3 and 4. As illustrated in FIG. 3, this embodiment also relates to the skirt 1 including the body part 2 formed into the cylindrical shape by sewing the front body part 2*a* and the back body part 2*b* together and the waistband part 3 circumferentially provided at the upper end of the body part 2. In this embodiment, as illustrated in FIG. 4, one flat rubber band 6' is encapsulated in the waistband part 3.

Figure 4:
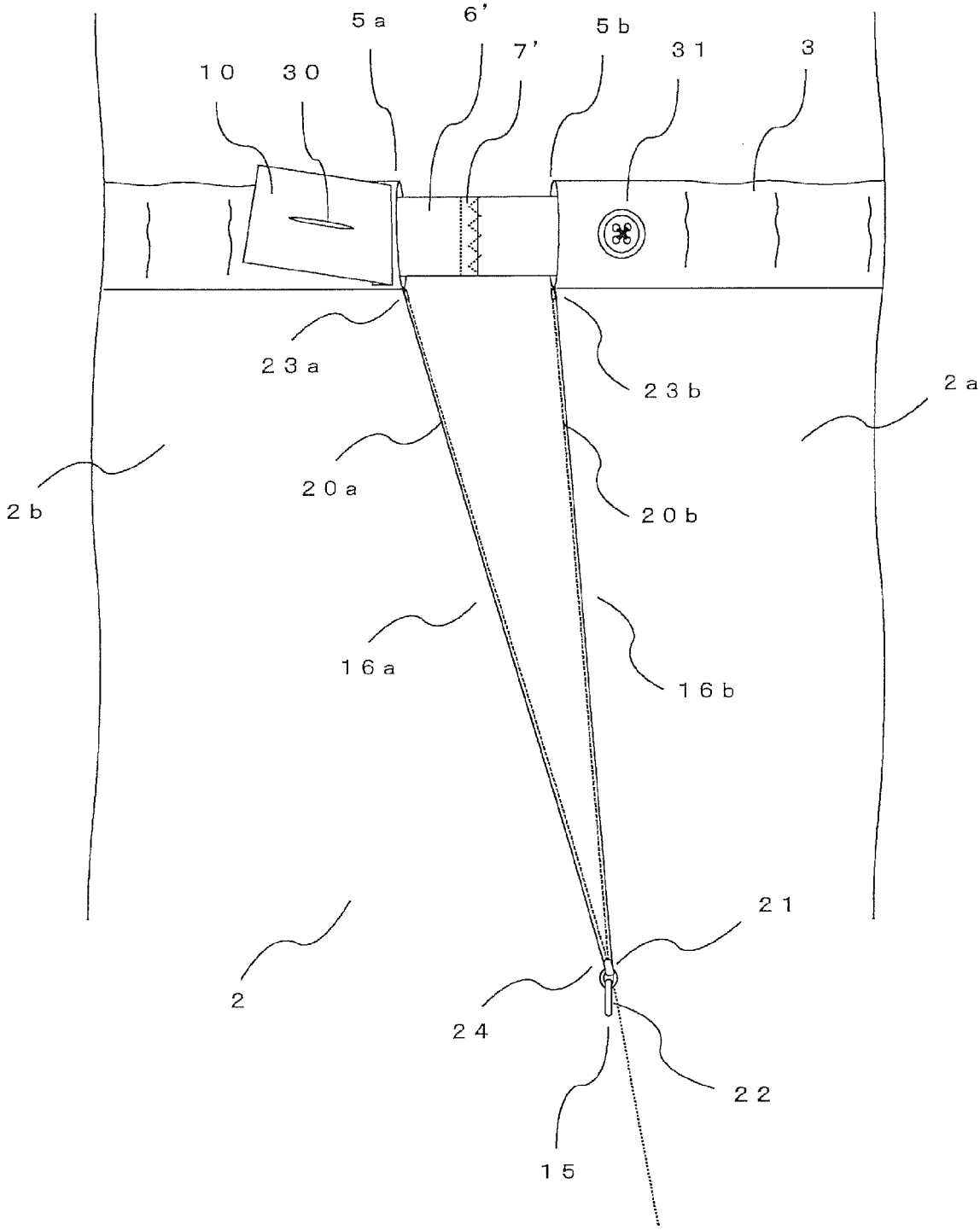
FIG. 4 is a partially enlarged view of the skirt according to the second embodiment.

As illustrated in FIG. 4, the rubber band 6' is formed in a ring shape with its opposite ends coupled together and the opposite ends are sewn together by using a sewing machine as coupling means 7' in this embodiment.

As illustrated in FIG. 4, the locking piece 10 provided on the surface in the vicinity of the end portion 5*a* of the waistband part 3 is formed with a buttonhole 30, a button 31 is sewn in a proper position on a surface in the vicinity of the end portion 5*b*, and the end portions 5*a*, 5*b* of the waistband part 3 can be engaged with and detached from each other by fastening or undoing the button 31 through the buttonhole 30.

In this embodiment, as illustrated in FIG. 3, the front body part 2*a* and the back body part 2*b* are diagonally bonded to each other to form the body part 2 and the opening/closing portions 16*a*, 16*b* having the fastener which is the opening/closing means 15 are positioned on a bonding line.

If a wearer wants to change a waist size of the skirt 1 according to this embodiment, the coupling means 7' of the rubber band 6' encapsulated in the waistband part 3 is exposed to undo the coupling, a length of the rubber band 6' is adjusted to a required length, and the opposite ends of the rubber band 6' are coupled together again by using the sewing machine.

Even in a skirt in which opposite ends of one flat rubber band 6' are sewn and coupled together by using a sewing machine and a buttonhole 30 and a button 31 are used as the locking means 7' of the locking piece 10 as in the skirt 1 according to this embodiment, the wearer can easily adjust the waist size by herself.

Even if the opening/closing portions 16*a*, 16*b* need be arranged diagonally according to design of the clothing, the present invention can be used.

Third Embodiment

Figure 5:
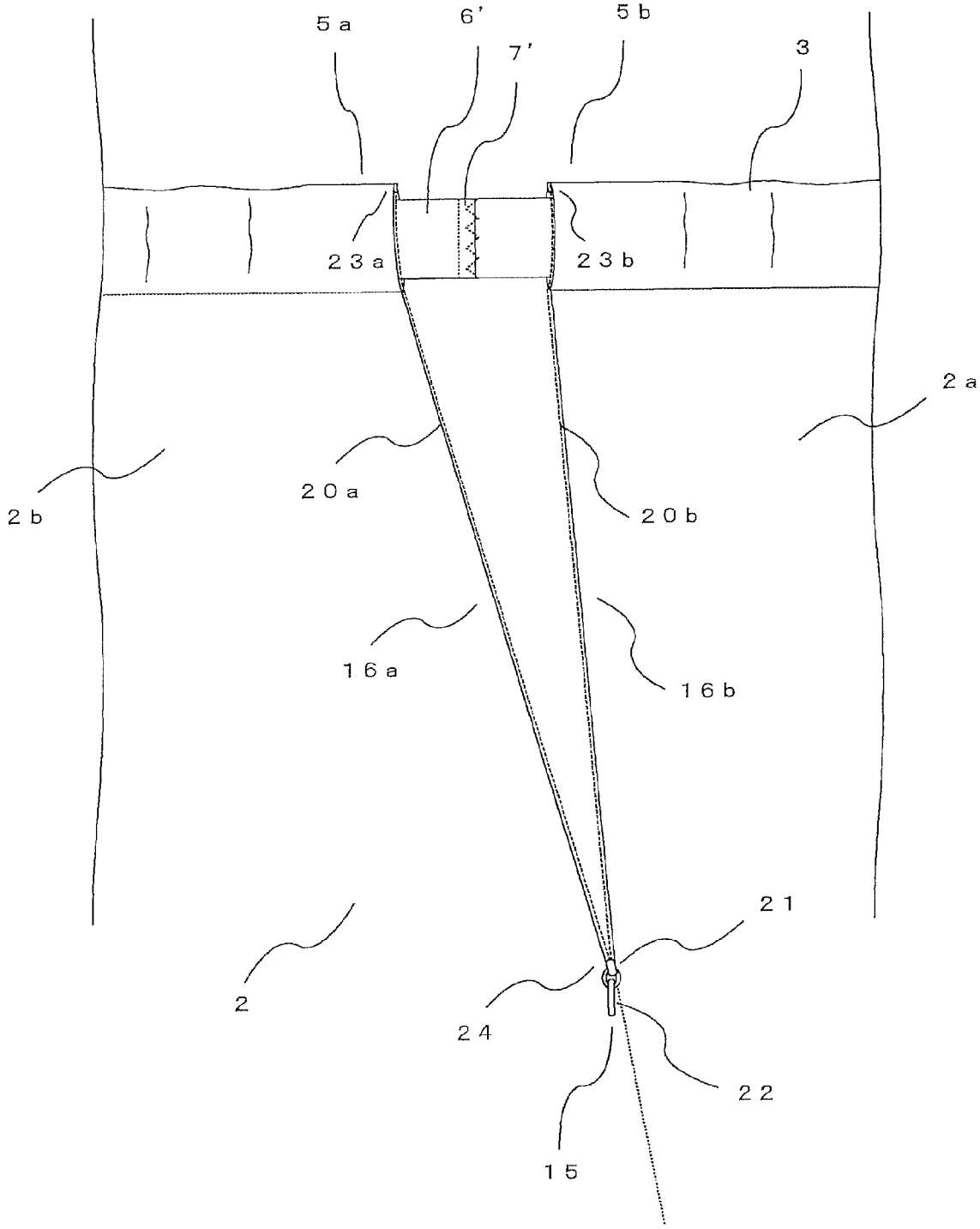
FIG. 5 is a partially enlarged view of a skirt according to a third embodiment.

A third embodiment relates to a modification of the aforementioned embodiments and is formed of a body part 2 formed by sewing a front body part 2*a* and a back body part 2*b* together and a waistband part 3 formed into a sack shape by respectively folding back upper ends of the front body part 2*a* and the back body part 2*b* as illustrated in FIG. 5.

In this embodiment, unlike the aforementioned embodiments, opposite end portions 5*a*, 5*b* of the waistband part 3 are not provided with the locking piece or the button. A pair of left and right engaging portions 20*a*, 20*b* provided along edge portions of the opening/closing portions 16*a*, 16*b* extend to upper edges of the opposite end portions 5*a*, 5*b* of the waistband part 3 and upper ends 23*a*, 23*b* of the engaging portions 20*a*, 20*b* are aligned with the upper edges of the end portions 5*a*, 5*b* of the waistband part 3. As the fastener, an invisible fastener is used.

In this way, the opening/closing portions 16*a*, 16*b* integral with the opposite end portions 5*a*, 5*b* of the waistband part 3 can be separated leftward and rightward from each other to form a substantially V shape.

Because side cloths of the invisible fastener which stops at the upper edges of the opposite end portions 5*a*, 5*b* of the waistband part 3 are difficult to sew, they are cut at a fastener stop. The cut fastener side needs to be prevented from fraying and therefore is bonded and prevented from fraying by using an adhesive cloth or the like.

With the skirt according to this embodiment, a wearer can easily adjust the waist size by herself. Because the rubber band 6' is hidden when the fastener is closed, the skirt is excellent in appearance.

Fourth Embodiment

Figure 6:
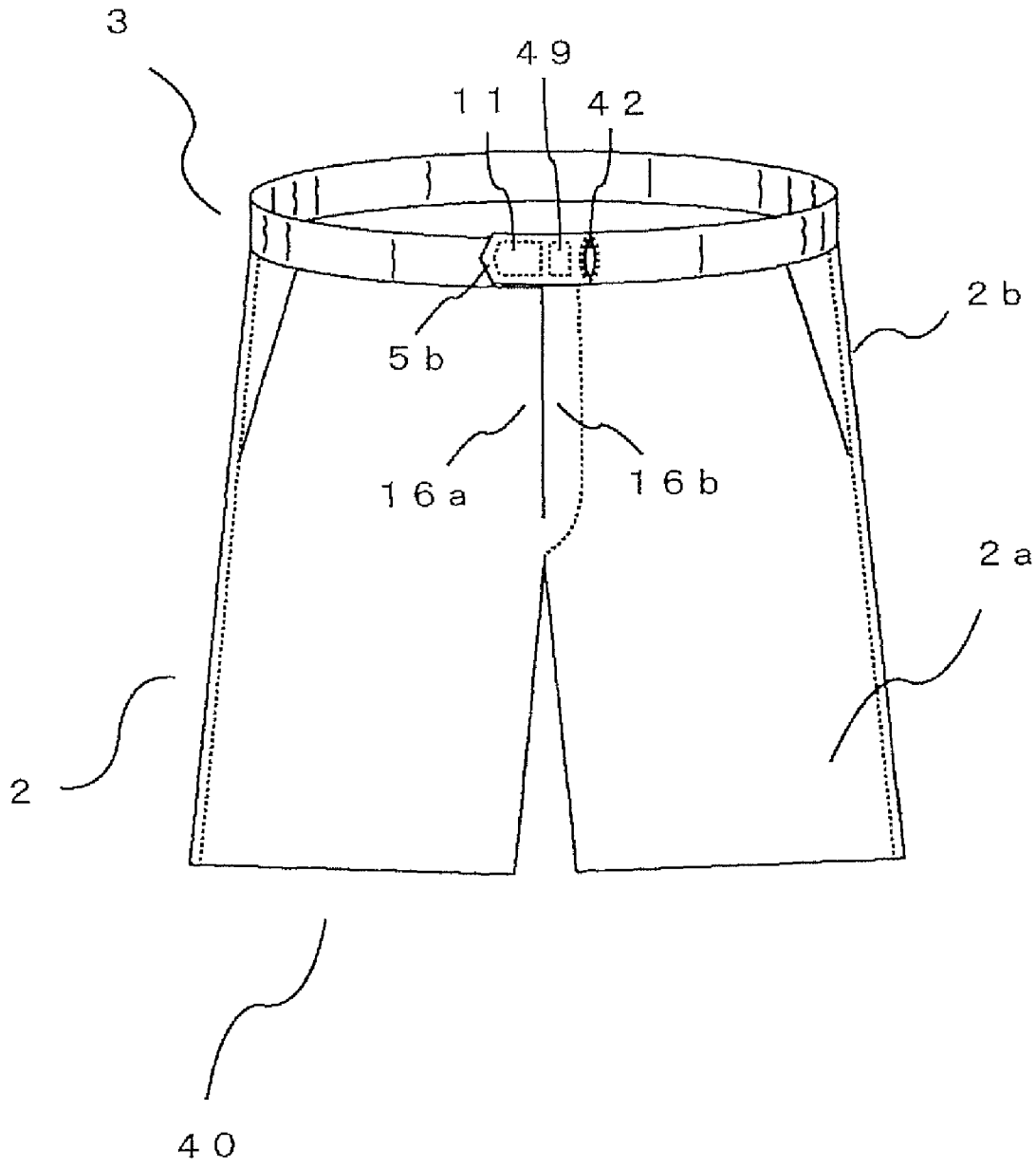
FIG. 6 is a front view of a pair of short trousers according to a fourth embodiment.

A fourth embodiment will be described with reference to FIGS. 6 and 7. As illustrated in FIG. 6, this embodiment relates to a pair of breeches 40 including a body part 2 formed by sewing a front body part 2*a* and a back body part 2*b* together and a long and narrow waistband part 3 circumferentially provided at an upper end of the body part 2.

Figure 7:
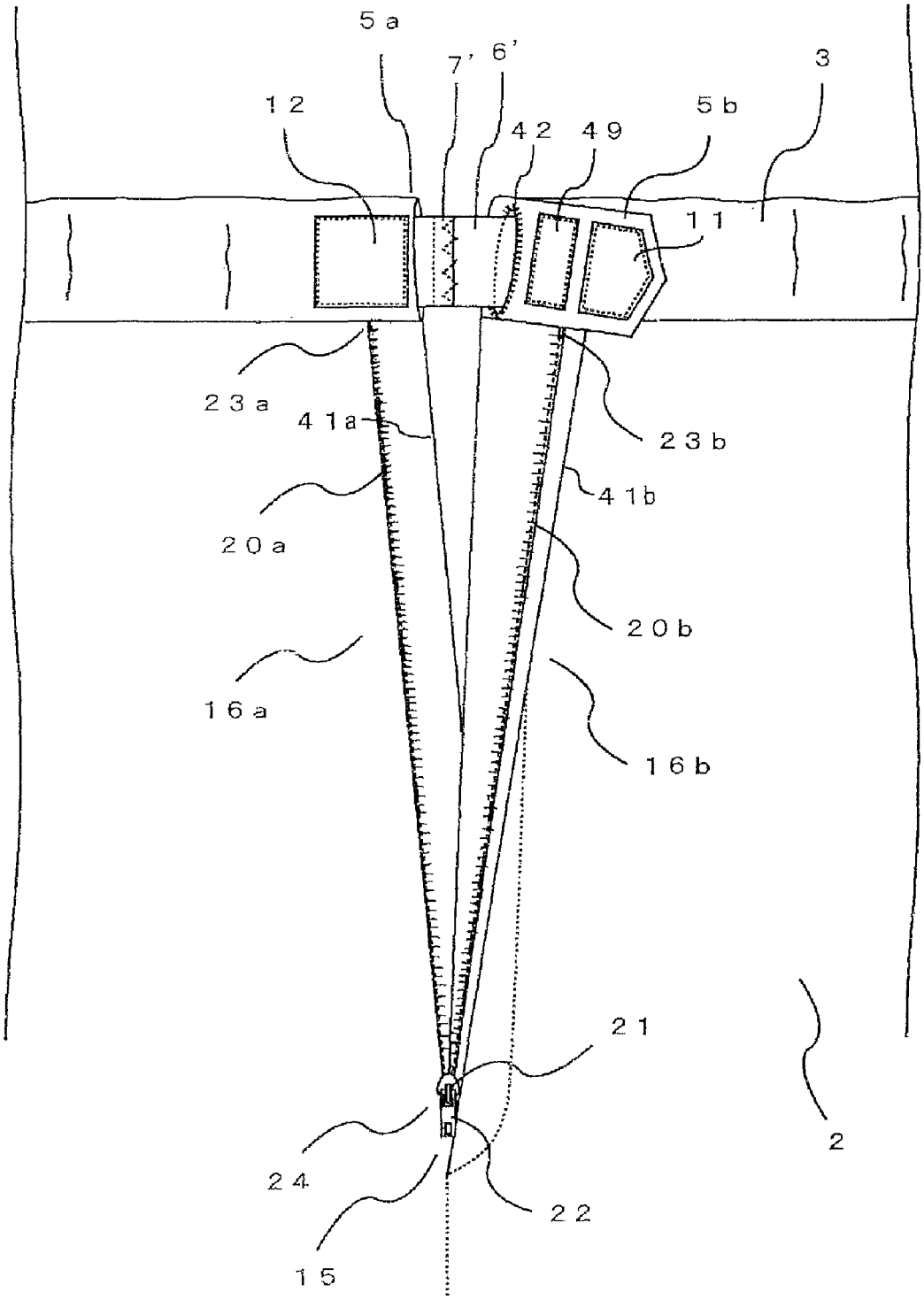
FIG. 7 is a partially enlarged front view of opening fastener of a pair of short trousers according to a forth embodiment.

As illustrated in FIG. 7, the waistband part 3 is cut and separated so as to have end portions 5*a*, 5*b* at an upper end of a center of the front body part 2*a* and is formed in a sack shape so that a flat rubber band 6' for elastically expanding and contracting in a circumferential direction of a waist can be encapsulated in the waistband part 3.

As illustrated in FIGS. 6 and 7, the waistband part 3 has such a circumference that the end portion 5*b* can be overlaid on the end portion 5*a*. A hole portion 42 is formed at a portion of the waistband part 3 about 5 cm inside a side end of the end portion 5*b*. (It will be appreciated that for clarity of illustration in FIG. 6 the hole 42 appears on the obverse side of the waistband 3, but the usual practice would be to provide the hole on the reverse side of the waistband 3.) The opposite ends of the rubber band 6' are exposed from the hole portion 42 and a side end of the end portion 5*a* and coupled by coupling means 7' such as sewing by using a sewing machine to form the rubber band 6' into a ring shape. The hole portion 42 can be provided in a proper position.

With a hook piece 12 sewn and formed on a surface in the vicinity of the end portion 5*a* and a loop piece 11 sewn and formed on a back face in the vicinity of the end portion 5*b* of a hook-and-pile fastener, the opposite end portions 5*a*, 5*b* of the waistband part 3 can be engaged with and detached from each other.

As illustrated in FIGS. 6 and 7, the front body part 2*a* is formed with opening/closing portions 16*a*, 16*b* extending from lower edges of the opposite end portions 5*a*, 5*b* of the waistband part 3 to a lower position so that the opening/closing portions 16*a*, 16*b* can be brought into contact with and separated from each other by a fastener which is opening/closing means 15. Thus normal fastener is used to man's trouser and front-open skirt.

As illustrated in FIG. 7, the fastener includes an engaging portion 20*a* provided at a predetermined distance from and parallel to an edge end 41*a* on a surface of the opening/closing portion 16*a*, an engaging portion 20*b* provided at a predetermined distance from and parallel to an edge end 41*b* on a back face of the opening/closing portion 16*b*, a slider body 21 for riding up and down the engaging portions 20*a*, 20*b*, and a slider pull 22 for operating the slider body 21. The opening/closing portions 16*a*, 16*b* integral with the opposite end portions 5*a*, 5*b* of the waistband part 3 can be separated leftward and rightward from each other to form a substantially V shape and the opening/closing portion 16*b* can be overlaid on the opening/closing portion 16*a*. As illustrated in FIG. 6, the fastener is positioned on the back face of the opening/closing portion 16*b* and invisible from the front when the opening/closing portions 16*a*, 16*b* are closed.

As described above, the structure of this embodiment can be used for every type of trousers such as a pair of trousers of a business suit, a pair of jeans, a pair of work trousers, and a pair of breeches irrespective of sex. The structure can also be used for a denim skirt. If the fastener has much overlap, the hole portion 42 may be provided at a portion inside the side edge of the end portion 5*b* and the rubber band 6' may be exposed from the hole portion 42 to thereby secure much overlap.

The hole portion 42 may be formed in a suitable position in a fastener without overlap, e.g., a fastener of a tight skirt, a flared skirt, a pair of trousers, or the like to put on the clothing. It is necessary to prevent fray around the hole portion 42.

In order to use the pair of breeches 40 having the aforementioned structure, the opposite end portions 5*a*, 5*b* of the waistband part 3 are engaged with and detached from each other and the opening/closing means 15 is moved up and down to put on and take off the pair of breeches 40.

To change the waist size, coupling of the coupling means 7' of the rubber band 6' encapsulated in the waistband part 3 is undone to adjust the length to a required length. Alternatively, the rubber band may be replaced with another of a proper length.

With the pair of breeches 40 according to this embodiment, the wearer can easily adjust the waist size by himself/herself. Besides, the end portion 5*b* and the opening/closing portion 16*b* can be overlaid on the end portion 5*a* and the opening/closing portion 16*a*; therefore, the fastener and the locking piece are not exposed to the surface when the pair of breeches is worn to thereby significantly enhance the appearance.

If a hard interlining is applied to an inside lining of the waistband part 3 excluding waist opposite sides, gathers become less likely to be formed in a front face and a back face of the waistband part 3 and only a few gathers are formed on the waist opposite sides to thereby significantly enhance the appearance as illustrated in FIG. 6. Especially, if this embodiment is applied to trousers of business suits for men and women, the wearer can easily stand up and sit down and adjust the waist by himself/herself. Besides, a leather belt, a fashionable belt, or the like may be wound around the waistband part 3 to thereby enhance the appearance.

Fifth Embodiment

A fifth embodiment will be described with reference to FIG. 8. This embodiment is a modification of the third embodiment and FIG. 8 is a partially enlarged view of a skirt 43 according to this embodiment viewed from a back side (inner side).

Figure 8:
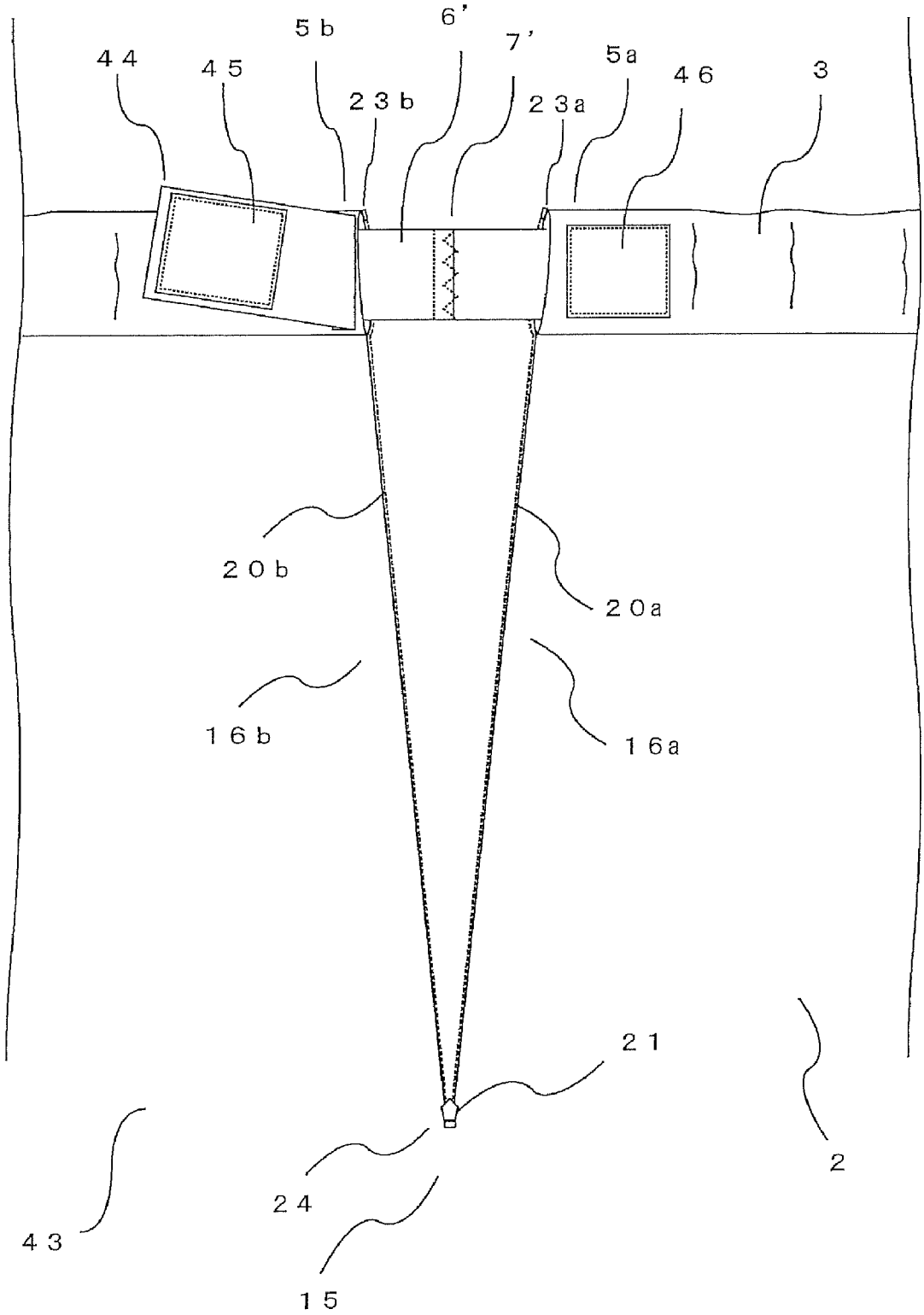
FIG. 8 is a partially enlarged view of fastener of skirt from inside according to the fifth embodiment.

As illustrated in FIG. 8, the skirt 43 according to this embodiment includes a body part 2 and a waistband part 3 formed into a sack shape by folding back an upper end of the body part 2. With a fastener provided to extend from the body part 2 to an upper edge of the waistband part 3, opening/closing portions 16*a*, 16*b* of the body part 2 integral with opposite end portions 5*a*, 5*b* of the waistband part 3 can be separated leftward and rightward from each other to form a substantially V shape.

In the skirt 43 according to this embodiment, as illustrated in FIG. 8, a locking piece 44 on which a loop piece 45 of a hook-and-pile fastener is sewn and formed is connected at its one end to a back face of the end portion 5*b* of the waistband part 3. With a hook piece 46 of the hook-and-pile fastener sewn and formed on a back face of the end portion 5*a* and the loop piece 45 of the hook-and-pile fastener, the fastener of the waistband part 3 is reinforced and the rubber band 6' on the back face is hidden.

With the skirt 43 according to this embodiment, it is possible to prevent the fastener from moving down by mistake when the skirt is worn. Moreover, the locking piece 44 is not exposed to the surface to thereby maintain the excellent appearance.

Sixth Embodiment

A sixth embodiment will be described with reference to FIGS. 9A and 9B. This embodiment is a modification of the first embodiment. As the rubber band encapsulated in the waistband part 3, a flat rubber band 6' is employed.

Figure 9A:
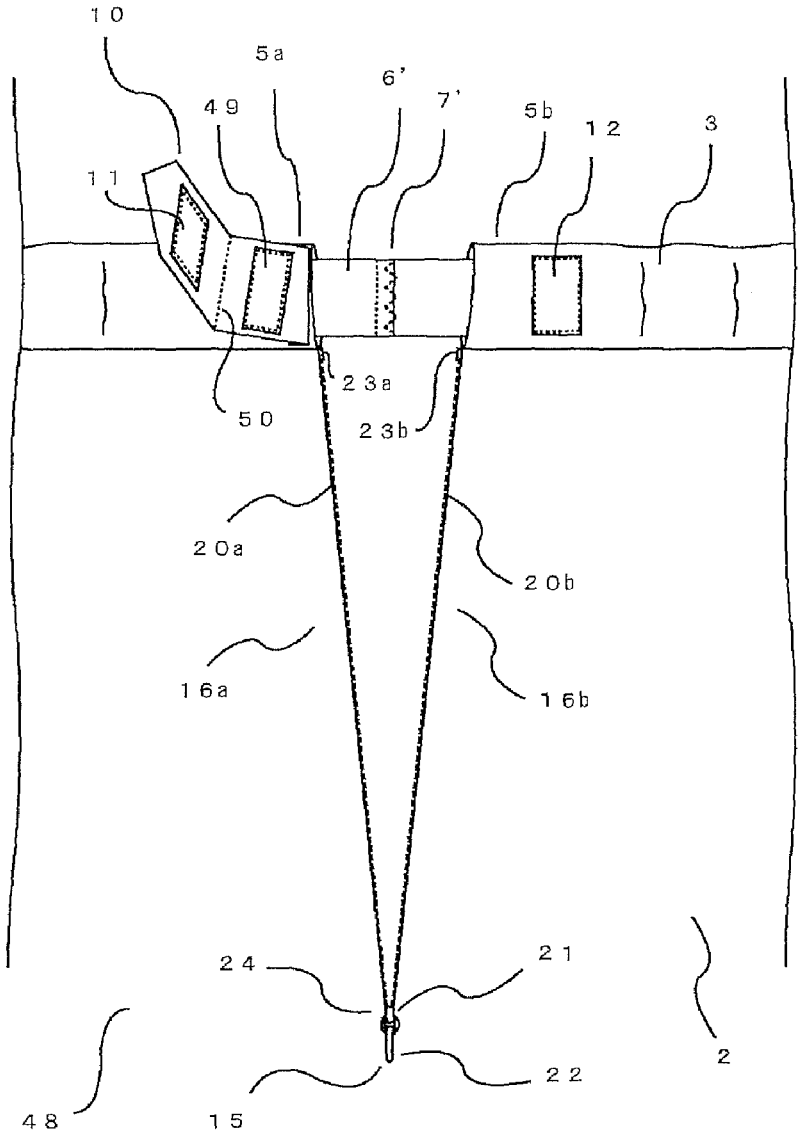
FIG. 9A is a partially enlarged view of a skirt according to a sixth embodiment.

As illustrated in FIG. 9A, the skirt 48 according to this embodiment is provided with a long and narrow locking piece 10 on a surface of the waistband part 3 in the vicinity of the end portion 5*a*. On a back face of the locking piece 10, the loop piece 11 of the hook-and-pile fastener and a hook part 49 of the hook-and-pile fastener are provided side by side at a predetermined interval. The locking piece 10 can be locked while being folded in two through a bending portion 50 formed between the loop piece 11 of the hook-and-pile fastener and the hook piece 49 of the hook-and-pile fastener. When the skirt 48 is put on, the loop piece 11 does not adhere to a hook piece 12; therefore, it is extremely easy to put on the skirt 48.

Moreover, as illustrated in FIG. 9A, on a surface in the vicinity of the end portion 5*b*, the hook piece 12 of the hook-and-pile fastener is formed in a position corresponding to the loop piece 11 of the hook-and-pile fastener of the locking piece 10. With the loop piece 11 of the hook-and-pile fastener and the hook piece 12 of the hook-and-pile fastener, the opposite end portions 5*a*, 5*b* of the waistband part 3 are engaged with and detached from each other.

In order to use the skirt 48 having the aforementioned structure, the skirt 48 is put on and taken off after the locking piece 10 is folded in two to lock the loop piece 11 of the hook-and-pile fastener and the hook piece 49 of the hook-and-pile fastener to each other.

While the skirt 48 is worn, the locking piece 10, which has been folded in two, is unfolded to lock the loop piece 11 of the hook-and-pile fastener of the locking piece 10 and the hook piece 12 of the hook-and-pile fastener of the end portion 5*b* to each other.

With the skirt 48 according to this embodiment, because the locking piece 10 can be folded in two through the bending portion 50 and locked, the loop piece 11 of the hook-and-pile fastener of the locking piece 10 does not adhere to other pieces of clothing during putting on and taking off of the skirt 48 and it is possible to put on and take off the skirt 48 very smoothly.

Figure 9B:
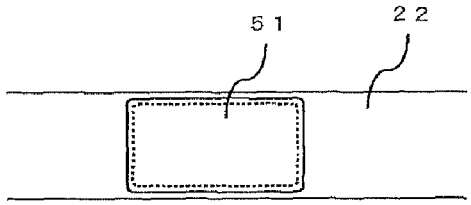
FIG. 9B is a explanation views of a reinforcing plate according to a sixth embodiment.

FIG. 9B is a partially enlarged view of the rubber band 6'. In this embodiment, as illustrated in FIG. 10B, a reinforcing plate 51 is provided in a front central position of the rubber band 6' so as to prevent bending of the rubber band 6'. The reinforcing plate 51 is made of thin and hard material such as synthetic resin and is sewn on the rubber band 6' at its peripheral edge by using a sewing machine or the like. However, the reinforcing plate 51 may be sewn only at its central portion. The reinforcing plate 51 may be provided also in a case in which a belt interlining is used instead of the rubber band 6'. The reinforcing plate 51 may be of any size.

Seventh Embodiment

Figure 10:
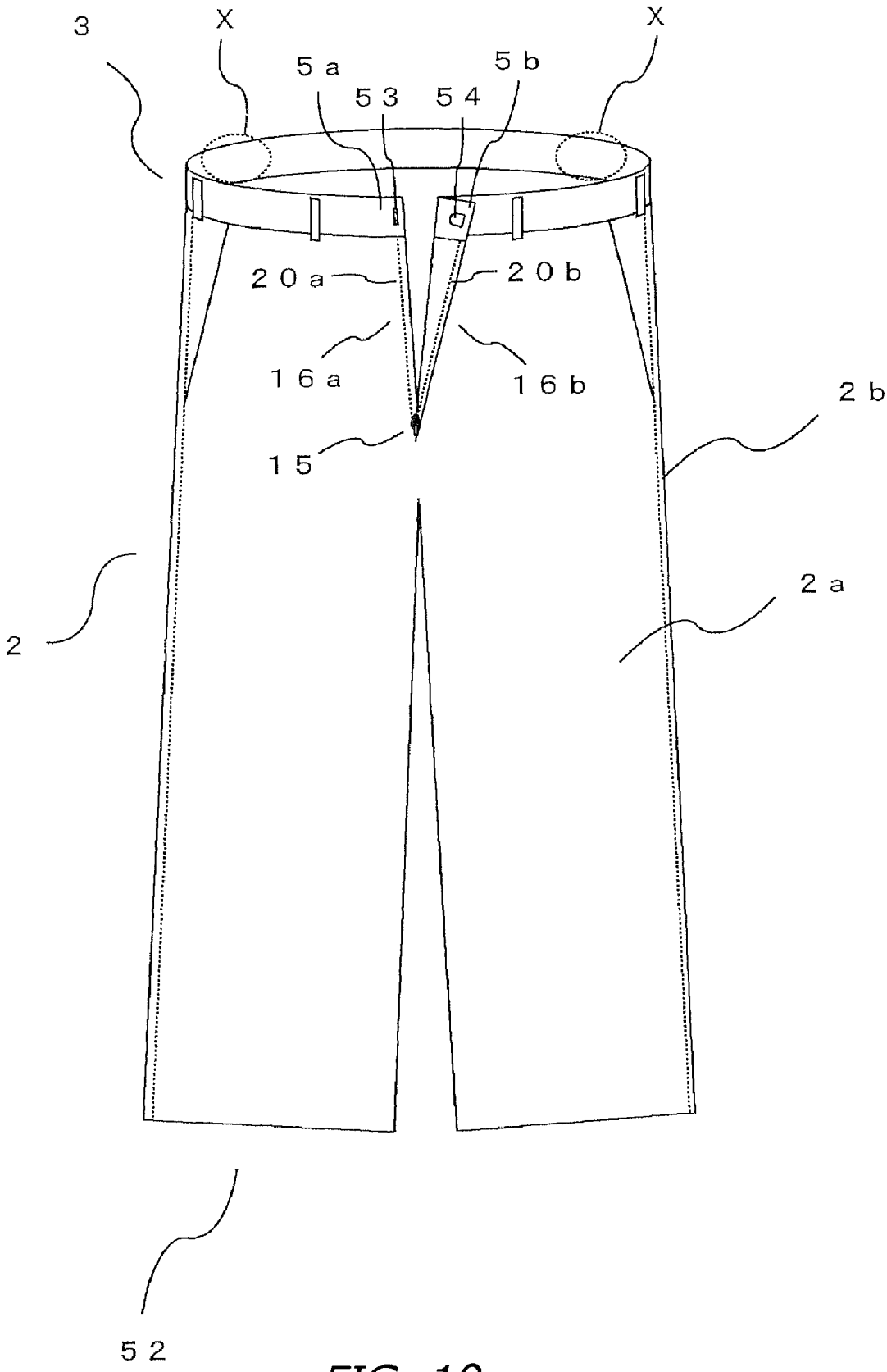
FIG. 10 is a front view of a pair of trousers according to a seventh embodiment.

A seventh embodiment will be described with reference to FIGS. 10 and 11. As illustrated in FIG. 10, this embodiment relates to a pair of trousers 52 including a body part 2 formed by sewing a front body part 2*a* and a back body part 2*b* together and a long and narrow waistband part 3 circumferentially provided at an upper end of the body part 2.

As illustrated in FIG. 10, the waistband part 3 is cut and separated so as to form end portions 5*a*, 5*b* at a central upper end of the front body part 2*a* and is formed in a sack shape so that a belt interlining can be encapsulated in a waist circumferential direction in the waistband part 3.

As illustrated in FIG. 10, the waistband part 3 has such a circumference that the end portion 5*b* can be overlaid on the end portion 5*a*. With a piece of locking hardware 53 provided on a surface in the vicinity of the end portion 5*a* and a hook-shaped hook 54 provided on a back face in the vicinity of the end portion 5*b*, the opposite end portions 5*a*, 5*b* of the waistband part 3 can be engaged with and detached from each other.

As illustrated in FIG. 10, the front body part 2*a* is formed with opening/closing portions 16*a*, 16*b* extending from a position at lower edges of the opposite end portions 5*a*, 5*b* of the waistband part 3 to a lower position so that the opening/closing portions 16*a*, 16*b* can be brought into contact with and separated from each other by a fastener which is opening/closing means 15. As illustrated in FIG. 10, the fastener includes an engaging portion 20*a* provided on a surface of the opening/closing portion 16*a* and an engaging portion 20*b* provided on a back face of the opening/closing portion 16*b*, the opening/closing portions 16*a*, 16*b* integral with the opposite end portions 5*a*, 5*b* of the waistband part 3 can be separated leftward and rightward from each other to form a substantially V shape, and the opening/closing portion 16*b* can be overlaid on the opening/closing portion 16*a* so that the fastener is positioned on the back face of the opening/closing portion 16*b* and invisible from the front when the opening/closing portions 16*a*, 16*b* are closed.

Figure 11:
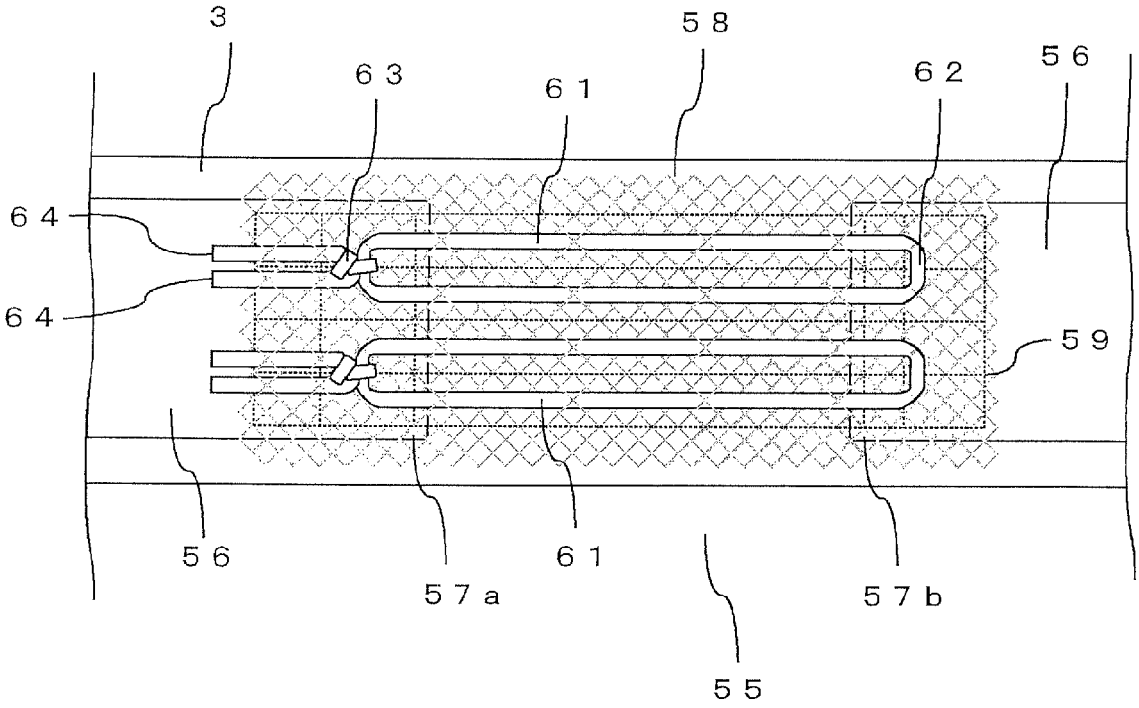
FIG. 11 is a partially enlarged view of the pair of trousers according to the seventh embodiment.

The pair of trousers according to this embodiment includes waist size adjusting portions 55 as illustrated in FIG. 11 in proper positions (X) (waist opposite sides in this embodiment) of the waistband part 3. FIG. 11 is a partially enlarged view of the waist size adjusting portion 55 when an inside of the waistband part 3 is viewed from inside.

In the waist size adjusting portion 55, as illustrated in FIG. 11, a belt interlining 56 encapsulated in the waistband part 3 is cut and separated at a predetermined interval to form cut end portions 57*a*, 57*b* and a net-like member 58 in a laterally long rectangle covering the cut end portions 57*a*, 57*b* is overlaid from inside and secured to the cut end portions 57*a*, 57*b* and the waistband part 3 through vertical and lateral stitches 59.

As illustrated in FIG. 11, a string-like member 61 forms a bottom portion 62 on one end side and a knot which is coupling means 63 on the other end side and is routed in a ring shape across the cut end portion 57*a* and the cut end portion 57*b* while being able to slide and be hung in proper positions on meshes of the net-like member 58. Although the string-like members 61 are provided in upper and lower two rows in this embodiment, the members may be provided in three or two rows depending on a width of the belt interlining 56.

The bottom portion 62 of the string-like member 61 is preferably secured to the cut end portion 57*b* and the waistband part 3 by stitches 59.

A mode of use of the pair of trousers 52 having the aforementioned structure will be described. When the pair of trousers 52 is on sale, an end portion 64 of the string-like member 61 is pulled in a waist direction to gather a portion between the cut end portions 57*a*, 57*b* in the waist direction. Then, the knot 63 is formed on the string-like member 61 to retain the shortened circumference of the waistband part 3.

When a buyer wants to increase the waist size due to a change in his/her figure, coupling of the coupling means 63 of the string-like member 61 is undone to stretch the portion between the cut end portions 57*a*, 57*b* in the waist direction to make an adjustment so that the waistband part 3 has a required circumference. When the waistband part 3 is stretched to a desired circumference, the knot 63 is formed again to thereby retain the desired waist size. Thus, in this embodiment, about 6 cm adjustment of the waist size is possible.

The end portion 64 of the string-like member 61 is preferably hung on the meshes of the net-like member 58 as illustrated in FIG. 11. If using an adhesive or the like hardens the end portion 64 of the string-like member 61, it is easy to pass the end portion 64 through the meshes.

With the pair of trousers 52 according to this embodiment, because the waist size adjusting portion 55 is provided, the wearer can easily adjust the waist size by himself/herself. Furthermore, the waist size adjusting portion 55 is invisible from the front to thereby significantly enhance the appearance.

According to the present invention, the wearer can easily adjust the waist size by himself/herself and need not be careful about a change in the waist in standing up and sitting down. Moreover, it is unnecessary to provide a snap, a hook, or the like. The present invention can be used for a wide range of clothing from adults' to children's irrespective of sex, has an excellent appearance, and has industrial applicability.

In order to use the pair of breeches 40 having the aforementioned structure, the opposite end portions 5*a*, 5*b* of the waistband part 3 are engaged with and detached from each other and the opening/closing means 15 is moved up and down to put on and take off the pair of breeches 40.

To change the waist size, coupling of the coupling means 7' of the rubber band 6' encapsulated in the waistband part 3 is undone to adjust the length to a required length. Alternatively, the rubber band may be replaced with another of a proper length.

With the pair of breeches 40 according to this embodiment, the wearer can easily adjust the waist size by himself/herself. Besides, the end portion 5*b* and the opening/closing portion 16*b* can be overlaid on the end portion 5*a* and the opening/closing portion 16*a*; therefore, the fastener and the locking piece are not exposed to the surface when the pair of breeches is worn to thereby significantly enhance the appearance.

If a hard interlining is applied to an inside lining of the waistband part 3 excluding waist opposite sides, gathers become less likely to be formed in a front face and a back face of the waistband part 3 and only a few gathers are formed on the waist opposite sides to thereby significantly enhance the appearance as illustrated in FIG. 7. Especially, if this embodiment is applied to trousers of business suits for men and women, the wearer can easily stand up and sit down and adjust the waist by himself/herself. Besides, a leather belt, a fashionable belt, or the like may be wound around the waistband part 3 to thereby enhance the appearance.

Eighth Embodiment

Figure 12A:
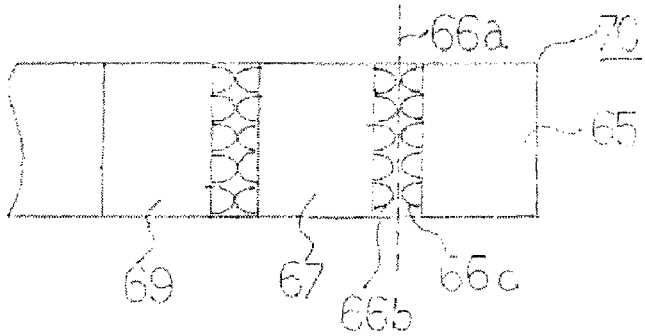
FIG. 12A is a partially enlarged view of the adjusting piece (loop) according to the eighth embodiment.
Figure 12B:
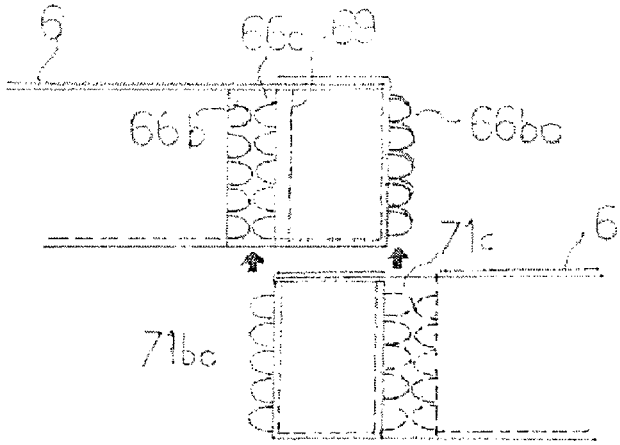
FIG. 12B is a explanation view of the status of join by adjusting piece (loop) according to the eighth embodiment.
Figure 12C:
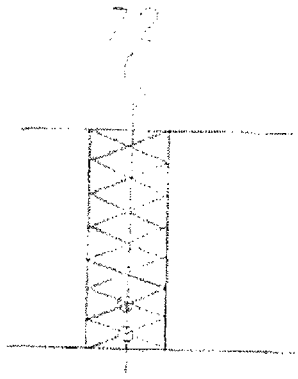
FIG. 12C is a partially enlarged view of the adjusting piece (net) according to the eighth embodiment.
Figure 13:
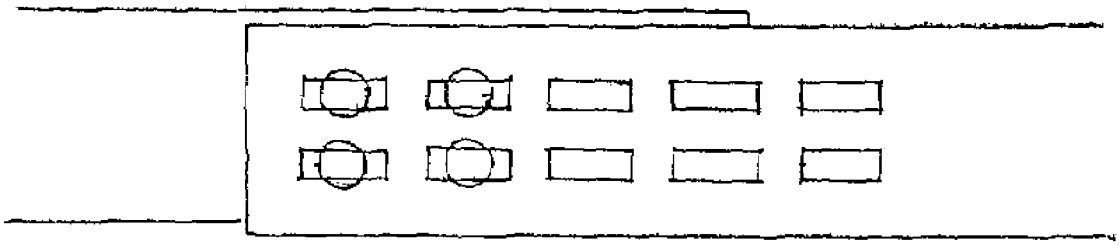
FIG. 13 is a explanation view of the method of adjusting rubber band by button (net) according to the eighth embodiment.

An eighth embodiment will be described with reference to FIGS. 12 and 13. As illustrated in FIG. 12, this embodiment relates to a method of joining wide rubber 6' by using net. As rubber band is plane, so it is preferable that the end of rubber band can be easily overlapped with being thicker. If using metal fittings for join, its thickness may become thick, so the method of rubber band is net or soft synthetic resin, and in this case metal may be used together. Example is illustrated a joining method to make net for in an anomalous style in a rubber band, but if an end of rubber band made of net, in several portion of other end of rubber band, faced net or loop-shaped adjusting stitch may be using illustrated in FIG. 12B, it can be able to join both net or loop-shaped stitch.

Detailed explanation is as follows. At first, an adjusting loop piece 70 (as illustrated in FIG. 12A) or an adjusting net piece 72 (as illustrated in FIG. 12C) is prepared. Follow explanation is executed as example loop piece.

Two line faced adjusting loop piece with determined space are sew on cloth 65, 67, 69, and the cloth may be other thin one. Loop must be stable and flexible to moving of waist for joining the end of waist belt with yarn wired in loop. It may be metal or synthetic resin. As illustrated in FIG. 12B, adjusting loop piece 70 is cover with the edge of one end of rubber band as fold up in the center of loop, and then loop line 66*b* lies upon loop line 66*c*. Edge of above edge loop is illustrated 66*bc*. Then loop edge 66*bc* may face to loop line 71*b* and 71*c* and likewise another end loop edge 71 bc may face to loop line 66*b* and 66*c*, and both loop can be sew with yarn. By this way rubber band can be adjusted to waist size. You may put strings through a loop through needles daringly then, but it is easy to come to insert it in a loop without tools such as needles when you harden the tip such as strings with paste and can come to easily unite with loop line. It becomes a stronger thread by scooping the part that four threads joined net (as illustrated circle in FIG. 12C) or loop-shaped join.

As mentioned above, it is easy to watch a loop line by assuming a loop line two lines yarn and it is easy to join and it can be able to reinforce strength of a loop by holding a part except a loop with cloth. Adjusting net piece or adjusting loop piece may be sew on the rubber band, and then if up and down end of loop must be sew at up and down end of rubber, it is preferable to be stable of loop and net.

To use thus adjusting net piece 72 and loop piece 70, it is easy to adjust the length of rubber band inserted into waist belt and after regulation, it is preferable without no pain of thickness of the rubber zone at the time of wearing. FIG. 13 is illustrated several button is used to join rubber band. In narrow rubber band being establish one line of (2, around 5) wide buttonhole and button, I wide it being establish two lines or three lines.

In this way, length adjusting is easy by changing button location and being fasten with several buttons, stable adjusting is capable without being broken at the center and without coming off because of abdominal pressure.

According to the present invention, the wearer can easily adjust the waist size by himself/herself and need not be careful about a change in the waist in standing up and sitting down. Moreover, it is unnecessary to provide a snap, a hook, or the like. The present invention can be used for a wide range of clothing from adults' to children's irrespective of sex, has an excellent appearance, and has industrial applicability.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

What is claimed is:

1. A clothing article comprising:

a body;

a sleevelike waistband provided circumferentially along an upper end of the body, and split by overlapping ends having circumferentially opposing mouths, wherein the mouth in one end opens along the waistband latterly, at about the distance from the tip of the one end by which the one end overlaps the other end;

an elastic band encapsulated in the waistband and elastically expandable and contractible circumferentially along the waist, the elastic band having opposing ends passing out of the opposing mouths in the waistband and coupled by coupling means for adjusting the length of the elastic band, the coupling means being composed of a meshwork row formed on each of the opposing ends of the elastic band, and a cord removably interlaced through the opposing meshwork rows;

an unfastenable locking means provided on the overlapping ends of the waistband, for locking the overlapping ends together to cover and hide the elastic band from being exposed from the ends of the waistband;

opening/closing portions formed by a split in the body, extending to a common terminal position and continuous with the split in the waistband; and an opening/closing means for closably separating the opening/closing portions away from each other.

2. A clothing article as set forth in claim 1, wherein:

said one overlapping end is creased so as to be foldable back on itself; and the locking means includes unfastenable means to hold said overlapping end fast when folded back on itself.

3. A clothing article as set forth in claim 1, wherein a belt interlining is included on the elastic band encapsulated in the sleevelike waistband.

4. A clothing article, comprising:

a body;

a sleevelike waistband provided circumferentially along an upper end of the body, and split by ends having circumferentially opposing mouths; and an elastic band encapsulated in the waistband and elastically expandable and contractible circumferentially along the waist, the elastic band having opposing ends passing out of the opposing mouths in the waistband and coupled by coupling means for adjusting the length of the elastic band, the coupling means being composed of a meshwork row formed on each of the opposing ends of the elastic band, and a cord removably interlaced through the opposing meshwork rows;

opening/closing portions formed by a split in the body, extending to a common terminal position and continuous with the split in the waistband; and opening/closing means extending across the split in the waistband, from the upper to the lower edges of the opposing ends thereof, and to the common terminal position, whereby the opening/closing portions continuous with the opposing ends of the waistband part are separable leftward and rightward from each other by the opening/closing means.

5. A clothing article as set forth in claim 4, wherein a belt interlining is included on the elastic band encapsulated in the sleevelike waistband.

6. A clothing article comprising:

a body;

a waistband provided circumferentially along an upper end of the body;

a belt interlining encapsulated in the waistband and in at least one predetermined location split in opposing belt-interlining ends separated to accommodate a waist-size adjustment; and a waist size adjustment composed of a flexible mesh fixed to the opposing ends of the belt interlining, and a cord laced through the mesh and tied in a loop to draw the opposing ends of the elastic band adjustably together.

* * * * *